United States Patent [19]

Schweiss et al.

[11] Patent Number: 5,045,183

[45] Date of Patent: Sep. 3, 1991

[54] DEVICE FOR SCREENING FIBER SUSPENSIONS

[75] Inventors: Peter Schweiss, Langenau; Reimund Rienecker, Heidenheim, both of Fed. Rep. of Germany

[73] Assignee: J. M. Voith GmbH, Heidenheim, Fed. Rep. of Germany

[21] Appl. No.: 554,262

[22] Filed: Jul. 17, 1990

[30] Foreign Application Priority Data

Jul. 28, 1989 [DE] Fed. Rep. of Germany ..... 3925020

[51] Int. Cl.[5] ..... D21D 5/16; B07B 1/04

[52] U.S. Cl. ..... 209/273; 209/306; 210/413

[58] Field of Search ..... 209/270, 273, 250, 306, 209/330; 210/413, 5; 162/55

[56] References Cited

U.S. PATENT DOCUMENTS 3,762,401 4/1973 Bolton, III et al. ..... 209/273 X
4,200,537 4/1980 Lamort ..... 209/273 X
4,855,038 8/1989 LeBlanc ..... 209/273
4,950,402 8/1990 Frejborg ..... 209/273 X

FOREIGN PATENT DOCUMENTS 129814 2/1978 Fed. Rep. of Germany ..... 209/273
40238 10/1913 Sweden ..... 209/270

*Primary Examiner*—Donald T. Hajec
*Attorney, Agent, or Firm*—Jeffers, Hoffman & Niewyk

[57] ABSTRACT

The rotor of a sorter has a circumference which, in cross section perpendicular to the rotor axis of rotation, is essentially composed of circular arcs. Depending on sorter size, the number of circular arcs amounts to between two and eight. The eccentricity of the circular arcs relative to their center, based on the rotor axis of rotation, amounts to preferably between 4 and 10 mm. This makes it possible to obtain slight rotor stresses at a good sorting efficacy, preferably also with a mean substance density of more than 3% of fiber suspensions. The difference between the smallest and greatest rotor spacing $e = f_{max} - f_{min}$ amounts to maximally 60 mm, preferably 20 mm.

5 Claims, 2 Drawing Sheets

DEVICE FOR SCREENING FIBER SUSPENSIONS

BACKGROUND OF THE INVENTION

The invention concerns a device for screening fiber suspensions with a rotationally symmetric screen basket and a coaxial rotor arranged radially inside said basket.

Such devices with screen baskets essentially serve to remove disturbing ingredients of fiber suspensions, for instance lightweight, floating contaminants, such as plastic foils and the like, heavy ingredients, such as sand, glass splinters, wood chips, and iron parts of essentially small type, such as staples, wire pieces, etc. This is accomplished by a suitable dimensioning of the screen perforation or slot width of the screen or screen basket so that only the good fibers or also fiber bundles can proceed into an accepts space.

A good sorting efficiency requires that additionally the following conditions be met:

1. The generation of gravity forces and the maintenance of a turbulent movement in the suspension is necessary in order to prevent the formation of fiber flakes, especially at solid substance concentrations of more than 0.8%, and a demixing of the suspension in fibers and water on the screen. In the latter case, a thickening would occur on the screen that would prevent the passage of further accepts through the screen openings.

2. The generation of pressure pulsations on the screen so as to eliminate or prevent cloggings of the screen openings through, for example, fiber flakes and foreign bodies.

Recently, attempts have been made at performing the sorting operation at maximally high substance concentrations. As a result, novel rotors have been developed, of which the arrangement according to the U.S. Pat. No. 4,200,537 is an example. Such rotors have a good sorting efficiency but stress the screen basket quite heavily.

The problem underlying the invention is to provide a rotor which, while having a good sorting efficiency, causes only minimal stresses on the screen basket.

SUMMARY OF THE INVENTION

This problem is inventionally solved through the features of the present invention, wherein a device for screening fiber suspensions is provided. The device comprises a rotationally symmetric screen basket having an inside radius $R_s$, and a rotor rotatable about an axis of rotation $M_O$. The rotor is coaxial to and arranged radially inside said screen basket. The rotor has a circumference such that at any cross section of the rotor, perpendicular to the axis of rotation, the circumference is substantially formed of circular arcs having a uniform mutual angular offset and an equal radius $R_r$ that is smaller than the inside radius $R_s$ of said screen basket, according to the formula $R_r=R_s31\ f_{max}$, where $f_{min}$ is the least spacing of the rotor circumference from the screen basket, $f_{max}$ is the theoretical greatest spacing of the rotor circumference from the screen basket as the maximum spacing of the common tangent of adjacent circular arcs from the screen basket, and $f'_{max}$ is the actual greatest spacing of the rotor circumference from the screen basket when the spacing is fashioned so as not to follow the common tangent. Circular arcs having a uniform mutual angular offset are those wherein the circular arcs of the circumference of the rotor are mutually distributed generally equidistant (equally) around the circumference. This actual, greatest spacing is maximally equal to $1.15 \cdot f_{max}$, with the spacing between $f_{min}$ and $f'_{max}$ increasing generally steadily, and wherein the radius $R_r$ has a maximum variation of 5% of the value as given by the above formula in the form of an elliptic or similar rotor contour, and wherein the circular arcs have a contour transition therebetween. The contour transition is fashioned as a common tangent or secant of adjacent circular arcs or is bow-shaped and concave. Further, the difference $e=f_{max}-f_{min}$ is maximally 60 mm, and $f_{min}$ ranges between 15 mm and 45 mm and E ranges between 5 mm and 100 mm, with $a=360°/2n$, $E=e/(1-\cos a)$ when angle a equals one-half the angular spacing of two rotor contour points that are adjacent in the peripheral direction of the rotor, with the least spacing $f_{min}$ from the screen basket. When E is the offset of the center M of the circular arcs of the rotor from the axis of rotation $M_O$, $e=f_{max}-f_{min}$ and n equals the number of circular arcs of each rotor cross section.

Inventionally it has been recognized that such a rotor will generate relatively "gentle" pulsations which proceed in the form of a gentle cycle.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplification set out herein illustrates a preferred embodiment of the invention, in one form, and such exemplifications are not to be construed as limiting the scope of the invention in any manner.

DESCRIPTION OF THE PREFERRED EMBODIMENT

Figure 1:
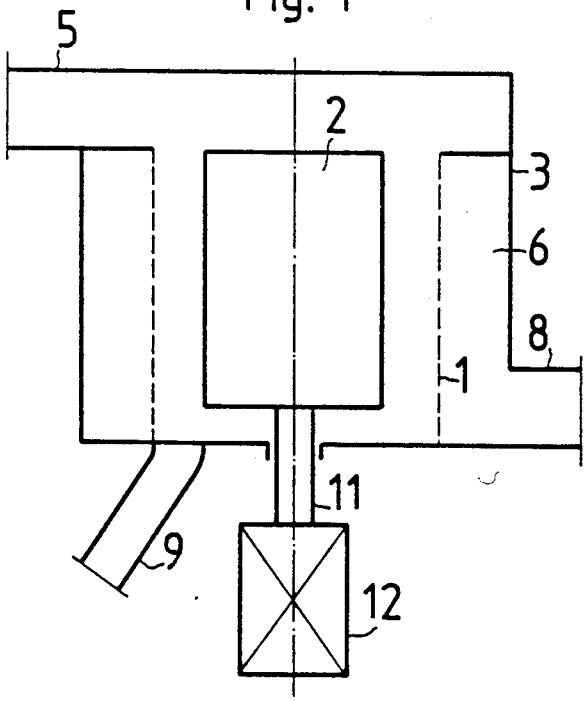
FIG. 1 shows a basic longitudinal sectional view of the sorter according to the present invention.

In FIG. 1, the screen basket is marked 1 and the rotor 2. The suspension is supplied to the housing 3 through the inlet socket 5 while the separated accepts are drained from the accepts space 6 through the outlet socket 8, and the remainder of the suspension is removed through the socket 9. The rotor drive is indicated at 12, driving the rotor by means of the sketched shaft 11.

Figure 2:
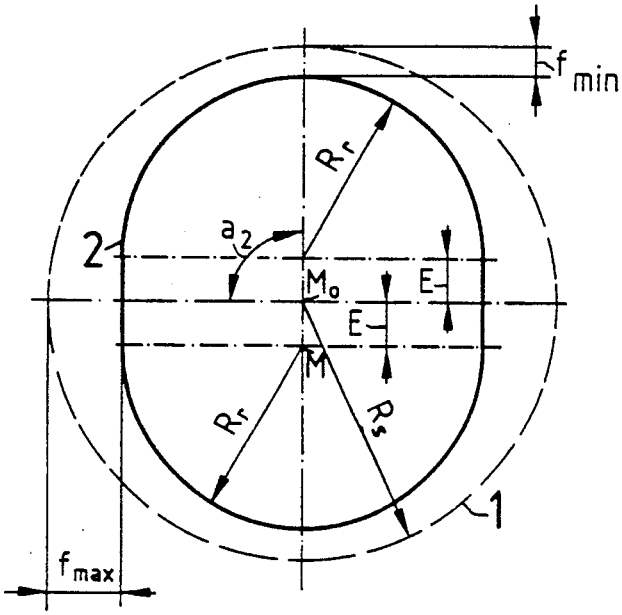
FIG. 2 shows a cross section relative to it.

According to FIG. 2, the circumference of the rotor 2, in cross section, i.e., in sections perpendicular to the rotor axis or rotor shaft 11, is composed of circular arcs with a radius $R_r$, which here are connected with each other by a straight connecting section. Obtained thereby is an eccentricity E of the center $M_1$ of the circular arcs of the rotor relative to the rotor axis of rotation $M_O$. In the center of the circular arcs, relative to the screen basket 1, there occurs a minimum gap of $f_{min}$, while at one-half the angular range between two adjacent minimal gaps $f_{min}$ there is located the maximum gap $f_{max}$. The difference between these two gaps is designated as e.

The basic rotor for a specific, small sorting size, as illustrated in FIG. 2, is fashioned with two circular arcs so that $n_1=2$. Similarly, in the embodiment shown in FIG. 3, three circular arcs are shown so that $n_2=3$. The angle $a_1$ is shown for the embodiment of FIG. 2 wherein $n_1=2$. Similarly, angle $a_2$ is shown for the embodiment of FIG. 3 wherein $n_2=3$. Similarly, angle a would be $a_3$ for $n_3=4$, and so forth. "n" is an integer which represents the number of circular arcs of the rotor cross section. Depending on the size of the sorting device for screening fiber suspensions, n generally amounts to between two and eight, preferably between two and about six.

Applicable to larger radii of the screen basket is then the following relation for the number (integral) of circular arcs $n = n_1 \cdot R_s/R_{s1}$. Additionally, the following relations apply $R_r=R_s-E-f_{min}$, where E=1, and $e=f_{max}-f_{min}$, where the angle a is one-half the angular range between two adjacent points of the rotor circumference with the least screen spacing $f_{min}$; at this point lies then the maximum distance $f_{max}$ of the rotor circumference from the screen basket 1. This angle a is then $a=360°/2n$.

A value in the range between 15 and 45 mm is preferably selected for the value $f_{min}$. The eccentricity E ranges preferably between 4 and 10 mm.

With a screen diameter of 500 mm, such an inventional rotor can maximally be given a speed of rotation of about 1400 rpm, which equals a peripheral speed of about 35 m/s. This results in a good sorting effect at a low power consumption of the rotor. Stresses upon the screen basket are relatively low.

Figure 3:
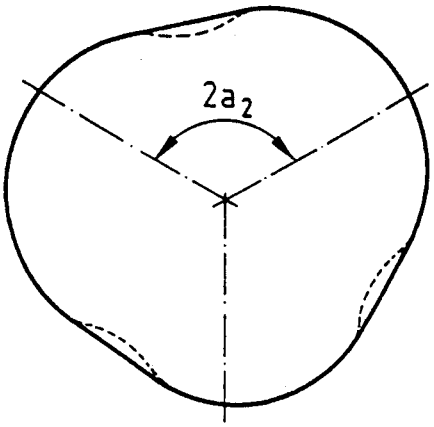
FIG. 3 shows a cross section of another embodiment.
Figure 4:
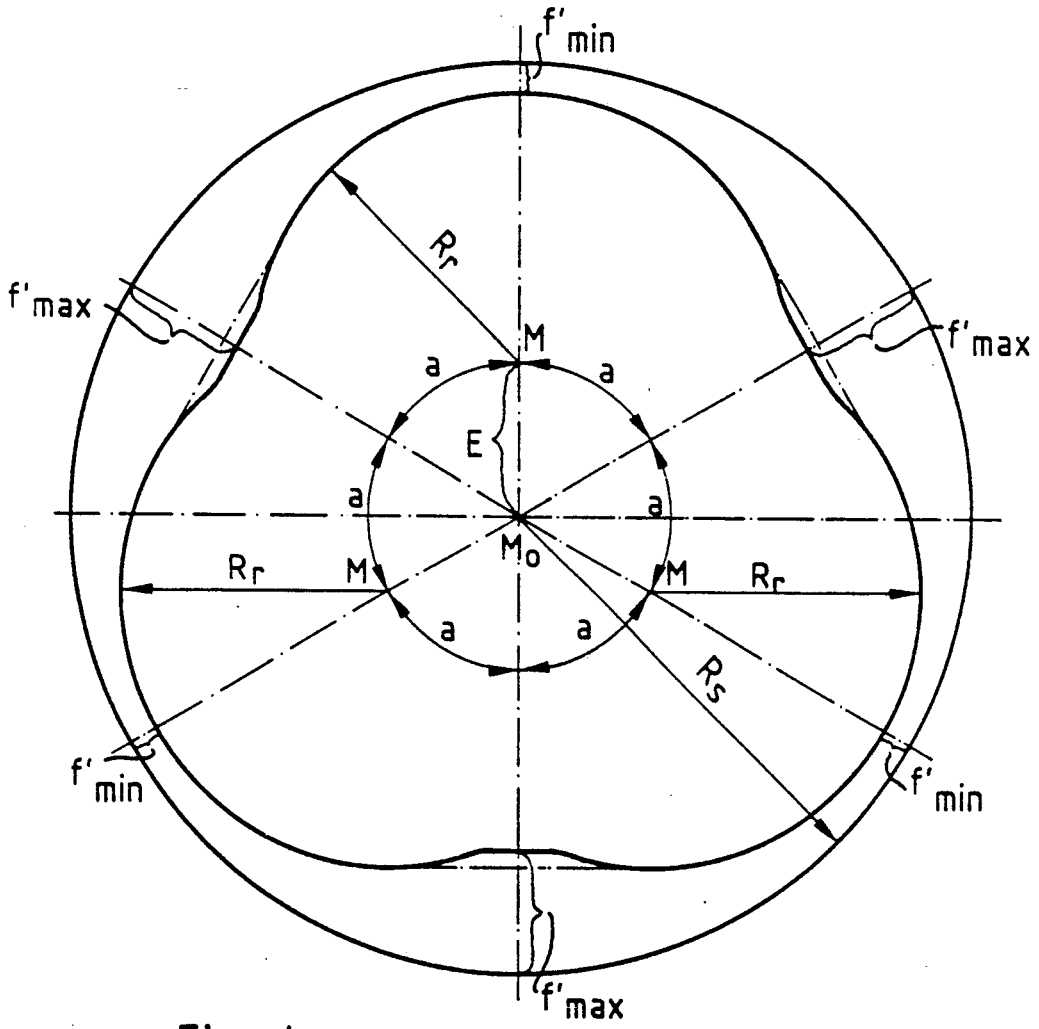
FIG. 4 shows the rotor of FIG. 3 showing both the common tangent and the common secant.

FIG. 3, and FIG. 4 additionally, shows the cross section of an inventional rotor whose circumference is composed essentially of three circular arcs of equal angular spacing from one another. The circular arcs, as illustrated by solid line, can also be connected by straight lines, which preferably extend parallel to the common tangent of adjacent circular arcs. The overall advantage is that of a low energy consumption at a high peripheral speed which is well suited for fluidization of substances with a medium substance density at more than 3%.

Rotors with two to four circular arcs forming the circumference of the rotor are preferably used. Naturally, this depends on the size of the sorter or the diameter of the screen basket.

The value for $e=f_{max}-f_{min}$ is maximally 60 mm, and preferably ranges between 5 and 20 mm. The rotor is then characterized by a surface which with regard to a fixed reference point has a shallow undulation and is moved past the screen basket at a high speed of rotation or velocity, with $f_{max}$ being the theoretically maximal spacing of the common tangent of adjacent circular arcs. In this area, i.e., at the point of one-half the angular range with the least rotor spacing, the actual spacing $f_{max}$ may be approximately maximally 15% greater, for instance where the rotor surface is fashioned corresponding to a common secant. Also bowed, concave connecting sections between the circular arcs (cylinder sections) and an approach overall through an ellipse (for the rotor with two circular arcs or cylinder sections) are applicable, with a variation from the theoretical circular radius $R_r$ of maximally 10%.

The actual maximum distance of the rotor surface from the screen basket 1 is to amount to maximally $1.15 \cdot f_{max}$, that is, 1.15 times the theoretical maximum spacing $f_{max}$ when the rotor contour is formed of circular arcs and common tangents connecting these, of adjacent circular arcs (or cylinder sections with tangential, level surfaces), but preferably $(1+0.2/n) \cdot f_{max}$.

The basic radius $R_{rl}$, for a screen basket or sorter with minimum dimensions, amounts to about 250–270 mm.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A device for screening fiber suspensions comprising:

a rotationally symmetric screen basket having an inside radius $R_2$;

a rotor rotatable about an axis of rotation $M_O$, said rotor being coaxial to and arranged radially inside said screen basket, said rotor having a circumference wherein at any cross section perpendicular to said axis of rotation said circumference is substantially formed of circular arcs having a uniform mutual angular offset and an equal radius $R_r$ that is smaller than said inside radius $R_s$ of said screen basket, according to the formula $R_r=R_s-f_{max}$, where $f_{max}$ is the theoretical greatest spacing of the rotor circumference from the screen basket as the maximum spacing of the common tangent of adjacent circular arcs from said screen basket; $f'_{max}$ is the actual greatest spacing of said rotor circumference from said screen basket when said spacing of said rotor circumference from said screen basket does not follow said common tangent, which spacing is maximally equal to $1.15 \cdot f_{max}$; $f_{min}$ is the least spacing of the rotor circumference from the screen basket wherein the spacing between $f_{min}$ and $f'_{max}$ increases generally steadily and wherein said radius $R_r$ has a maximum variation of 5% of the value as given by said formula in the form of a generally elliptic or similar rotor contour, and wherein said circular arcs have a contour transition therebetween, said contour transition being fashioned as a common tangent or secant of adjacent circular arcs; wherein e is the difference $f_{max}-f_{min}$, said difference $e=f_{max}-f_{min}$ being maximally 60 mm, and $f_{min}$ ranges between 15 mm and 45 mm and E ranges between 5 mm and 100 mm, with $a=360°/2n$, $E=e/(1-\cos a)$ when angle a equals one-half the angular spacing of two rotor contour points that are adjacent in the circumferential direction of the rotor, with the least spacing $f_{min}$ from the screen basket, and E is the offset of the center M of the circular arcs of the rotor from said axis of rotation $M_O$, $e=f_{max}-f_{min}$ and n equals the number of circular arcs of each rotor cross section.

2. A device as described in claim 1, wherein the value for $e=f_{max}-f_{min}$ ranges between 5 and 20 mm.

3. A device as described in claim 1, wherein the actual maximum spacing of the rotor surface from the screen basket $f'_{max}$ is maximally equal to $(1+0.2/n) \cdot f_{max}$, and where $n_1=2$ applies to a rotor with minimum dimensions corresponding to a slight sorter size with $R_{sl}$.

4. A device as described in claim 2, wherein the actual maximum spacing of the rotor surface from the screen basket $F'_{max}$ is maximally equal to $(1+0.2/n)\cdot f_{max}$, and where $n_1=2$ applies to a rotor with minimum dimensions.

5. A device for screening fiber suspensions comprising:

a rotationally symmetric screen basket having an inside radius $R_s$;

a rotor rotatable about an axis of rotation $M_O$, said rotor being coaxial to and arranged radially inside said screen basket, said rotor having a circumference wherein at any cross section perpendicular to said axis of rotation said circumference is substantially formed of circular arcs having a uniform mutual angular offset and an equal radius $R_r$ that is smaller than said inside radius $R_s$ of said screen basket, according to the formula $R_r=R_s-f_{max}$, where $f_{max}$ is the theoretical greatest spacing of the rotor circumference from the screen basket as the maximum spacing of the common tangent of adjacent circular arcs from said screen basket; further, $f'_{max}$ is the actual greatest spacing of said rotor circumference from said screen basket when said spacing of said rotor circumference from said screen basket does not follow said common tangent, which spacing is maximally equal to $1.15\cdot f_{max}$; $f_{min}$ is the least spacing of the rotor circumference from the screen basket wherein the spacing between $f_{min}$ and f'max increases generally steadily and wherein said radius $R_r$ has a maximum variation of 5% of the value as given by said formula in the form of a generally elliptic or similar rotor contour, and wherein said circular arcs have a contour transition therebetween, said contour transition being bowed and concave; further, e is the difference $f_{max}-f_{min}$, said difference $e=f_{max}-f_{min}$ being maximally 60 mm, and $f_{min}$ ranges between 15 mm and 45 mm and E ranges between 5 mm and 100 mm, with $a=360°/2n$, $E=e/(1-\cos a)$ when angle a equals one-half the angular spacing of two rotor contour points that are adjacent in the circumferential direction of the rotor, with the least spacing $f_{min}$ from the screen basket, and when E is the offset of the center M of the circular arcs of the rotor from said axis of rotation $M_O$, $e=f_{max}-f_{min}$ and n equals the number of circular arcs of each rotor cross section.

* * * * *

UNITED STATES PATENT AND TRADEMARK OFFICE

CERTIFICATE OF CORRECTION

PATENT NO. : 5,045,183

DATED : September 3, 1991

INVENTOR(S) : Peter Schweiss et al.

It is certified that error appears in the above-identified patent and that said Letters Patent is hereby corrected as shown below:

Claim 1, column 4, line 20, delete "$R_2$" and substitute therefor --$R_s$--;

Claim 4, column 5, line 3, delete "$F'_{max}$" and substitute therefor --$f'_{max}$--;

Claim 5, column 6, line 5, delete "f'max" and substitute therefor --$f'_{max}$--.

Signed and Sealed this

Ninth Day of March, 1993

*Attest:*

STEPHEN G. KUNIN

*Attesting Officer*

*Acting Commissioner of Patents and Trademarks*